US007857156B2

(12) United States Patent
Inomata

(10) Patent No.: US 7,857,156 B2
(45) Date of Patent: Dec. 28, 2010

(54) COLLAPSIBLE PLASTIC BOTTLE

(75) Inventor: Manabu Inomata, Tokyo (JP)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 11/665,458

(22) PCT Filed: Feb. 13, 2007

(86) PCT No.: PCT/JP2007/052899

§ 371 (c)(1),
(2), (4) Date: Jan. 2, 2009

(87) PCT Pub. No.: WO2007/094479

PCT Pub. Date: Aug. 23, 2007

(65) Prior Publication Data

US 2009/0114617 A1 May 7, 2009

(30) Foreign Application Priority Data

Feb. 14, 2006 (JP) ..... 2006-037256

(51) Int. Cl.
*B65D 1/02* (2006.01)
*B65D 1/42* (2006.01)

(52) U.S. Cl. ..... 215/381; 215/379; 215/900; 220/6; 220/666; 220/675

(58) Field of Classification Search ..... 215/379, 215/381, 800; 220/666, 675, 6, 907; 229/117.01; 222/107
See application file for complete search history.

(56) References Cited

U.S. PATENT DOCUMENTS 3,325,031 A 6/1967 Singier
3,340,869 A * 9/1967 Bane ..... 600/578
3,524,488 A * 8/1970 Scholle ..... 220/604
5,060,453 A * 10/1991 Alberghini et al. ..... 53/440
5,638,995 A * 6/1997 Mazda ..... 222/215
5,690,244 A * 11/1997 Darr ..... 215/382
6,179,152 B1 * 1/2001 Sarnowski ..... 220/549
2005/0072752 A1 * 4/2005 Yamanaka et al. ..... 215/381

(Continued)

FOREIGN PATENT DOCUMENTS

BE 668 632 A 12/1965

(Continued)

OTHER PUBLICATIONS

European Search Report for International Application No. PCT/JP2007 052899.

(Continued)

*Primary Examiner*—Sue A Weaver
(74) *Attorney, Agent, or Firm*—Finnegan Henderson Farabow Garrett & Dunner LLP

(57) ABSTRACT

A plastic bottle that can easily be collapsed after used is provided.

The plastic bottle has a body portion that is depressed internally by applying external force, and a depressible portion formed on a circumferential wall of the body portion to protrude externally. The depressible portion is depressed internally by applying external force. Plural depressible portions and plural depression-resistant portions may be formed alternately on the circumferential wall of the body portion in the circumferential direction of the body portion.

16 Claims, 6 Drawing Sheets

U.S. PATENT DOCUMENTS

2006/0118509 A1* 6/2006 Nottingham et al. ..... 215/381

FOREIGN PATENT DOCUMENTS

JP 08 244747 A 9/1996
JP 10 230919 A 9/1998
JP 11 070929 3/1999
JP 3108377 9/2000
JP 2005 239270 A 9/2005

OTHER PUBLICATIONS

English Language Abstract of Japanese Patent Publication 3108377.

* cited by examiner

COLLAPSIBLE PLASTIC BOTTLE

TECHNICAL FIELD

The present invention relates to a plastic bottle to be filled with liquid, particularly to a plastic bottle that, in light of plastic bottle disposal and recycling, or consumers who drink the liquid little by little, can have its spatial volume reduced after the liquid is drunk.

BACKGROUND ART

Generally, plastic bottles, as typified by PET bottles, are widely known as a container to be filled with beverages such as juices and soft drinks. Plastic bottles, when used, have to have predetermined strength to maintain their shape. Meanwhile, used empty plastic bottles are sometimes disposed, collection and recycling is preferable.

To efficiently collect used bottles, it is desirable that the bottles are collapsible and the collapsed bottles do not take up much space. Particularly, if consumers can easily collapse the bottles, the burden on the consumers when recycling the bottles can be reduced. Moreover, with such easily collapsible bottles, if a consumer collapses the bottle to put it into a collection box later and keeps the thus collapsed bottle in his/her bag, that bottle does not take up much space in the bag, so the handiness of used bottles can be improved.

As an example of those collapsible bottles, the bottle disclosed in JP 3,108,377 is well known. That bottle has an accordion-like structure formed with a large number of concave grooves in the longitudinal direction of the bottle. By collapsing the bottle horizontally to contract the accordion-like structure, the volume in the bottle can be reduced.

However, the plastic bottle disclosed in JP 3,108,377 is not so versatile, so it needs further improvement.

DISCLOSURE OF THE INVENTION

An object of the invention is to provide an easily collapsible plastic bottle to reduce the volume of space in a bottle after use.

To achieve the object, a plastic bottle in the invention has a body portion that collapses internally when external force is applied, and a depressible portion formed on a circumferential wall of the body portion to protrude externally. The depressible portion is depressed internally when the external force is applied.

With that configuration, the depressible portion is formed on the circumferential wall of the body portion, so the body portion in a used bottle can be easily collapsed by depressing the depressible portion. By collapsing the bottle, the volume of space in the empty bottle can be reduced. Because the depressible portion is formed to protrude externally, consumers or users can be made aware that the body portion can be collapsed by depressing the depressible portion.

Preferably, the plastic bottle also has a depression-resistant portion. The depression-resistant portion is formed on the circumferential wall of the body portion, and adjacent to the depressible portion. The depression-resistant portion resists depression from external force. Plural depressible portions and plural depression-resistant portions are formed alternately in the circumferential direction of the body portion.

With that configuration, the much more volume of space in the bottle can be reduced by depressing the plural depressible portions after use. Also, the strength of the body portion can be maintained by the depression-resistant portion. Accordingly, the strength and shape of the bottle can be maintained during use, and the bottle can be collapsed while maintaining the original strength of the bottle. Because the depression-resistant portion maintains the strength, freeness in design of the depressible portion can be improved. For example, the bottle can be designed so that the depressible portion in a used bottle can be depressed with a relatively small external force by making the thickness of the depressible portion less than that of the depression-resistant portion.

Preferably, the plural depressible portions and the plural depression-resistant portions are also formed alternately in a central axis direction.

With that configuration, the bottle can keep its strength and shape during use even better.

Preferably, when the depressible portions are depressed internally, they end up closer to the central axis than the depression-resistant portions.

With that configuration, the body portion of the collapsed bottle can become compact. Accordingly, storability and handiness of the used bottles can be improved: for example, the collapsed bottle does not occupy a large space in a recycling box.

Preferably, the plural depressible portions are configured not to interfere with each other in the body portion when they are depressed internally.

That configuration is useful in systems that deal with collapsed bottles, e.g. a recycling treatment system. More specifically, in the recycling treatment system, material used for bottles is recognized by detecting their transparency. The possibility of false detection of bottle transparency becomes lower by configuring the depressible portions so that they do not interfere with each other when depressed, as described above. Accordingly, the material used for the bottles can be recognized very reliably.

Preferably, the depressible portion is shaped so that its externally protruding section, excluding its top section, is curved or inclined.

With that configuration, compared with a perpendicularly vertical protruding section, the curved or inclined protruding section can easily be depressed when external force is applied to the depressible portion.

Preferably, the depressible portion includes a top section that protrudes externally the most, and a protruding section that continues into the periphery of the top section. The top section is curved to have its center of curvature inside the plastic bottle.

With that configuration, compared with a flat top section, the curved top section can be easily depressed when external force is applied to the top section. Accordingly, the depressible portion can easily be depressed.

Preferably, the top section extends in the central axis direction.

Another plastic bottle in the present invention has plural depressible portions formed on a circumferential wall of a body portion. The plural depressible portions are depressed internally when external force is applied.

With that configuration, the body portion can easily be collapsed by depressing the plural depressible portions, and the volume of space in the bottle can be reduced. Also, the body portion can be depressed at plural portions, so the volume reduction effect can be improved.

BEST MODE FOR CARRYING OUT THE INVENTION

A plastic bottle according to a preferred embodiment of the invention will be described below with reference to the attached drawings. In the following description, a widely available 500-ml plastic bottle is used as an example.

Figure 1:
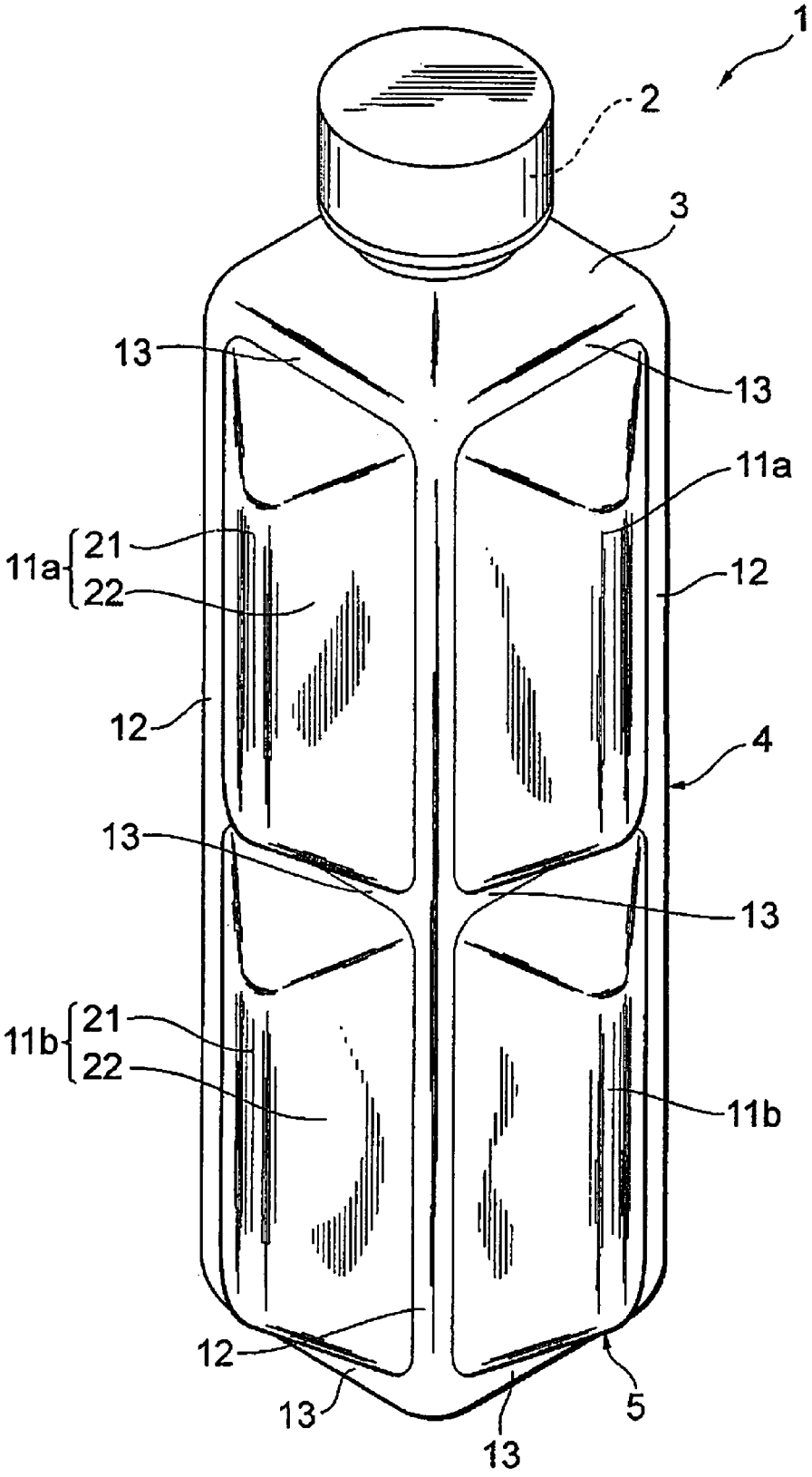
FIGS. 1, 2, and 3 are a perspective view, a front view, and a top view of a plastic bottle according to an embodiment of the present invention, respectively.
Figure 2:
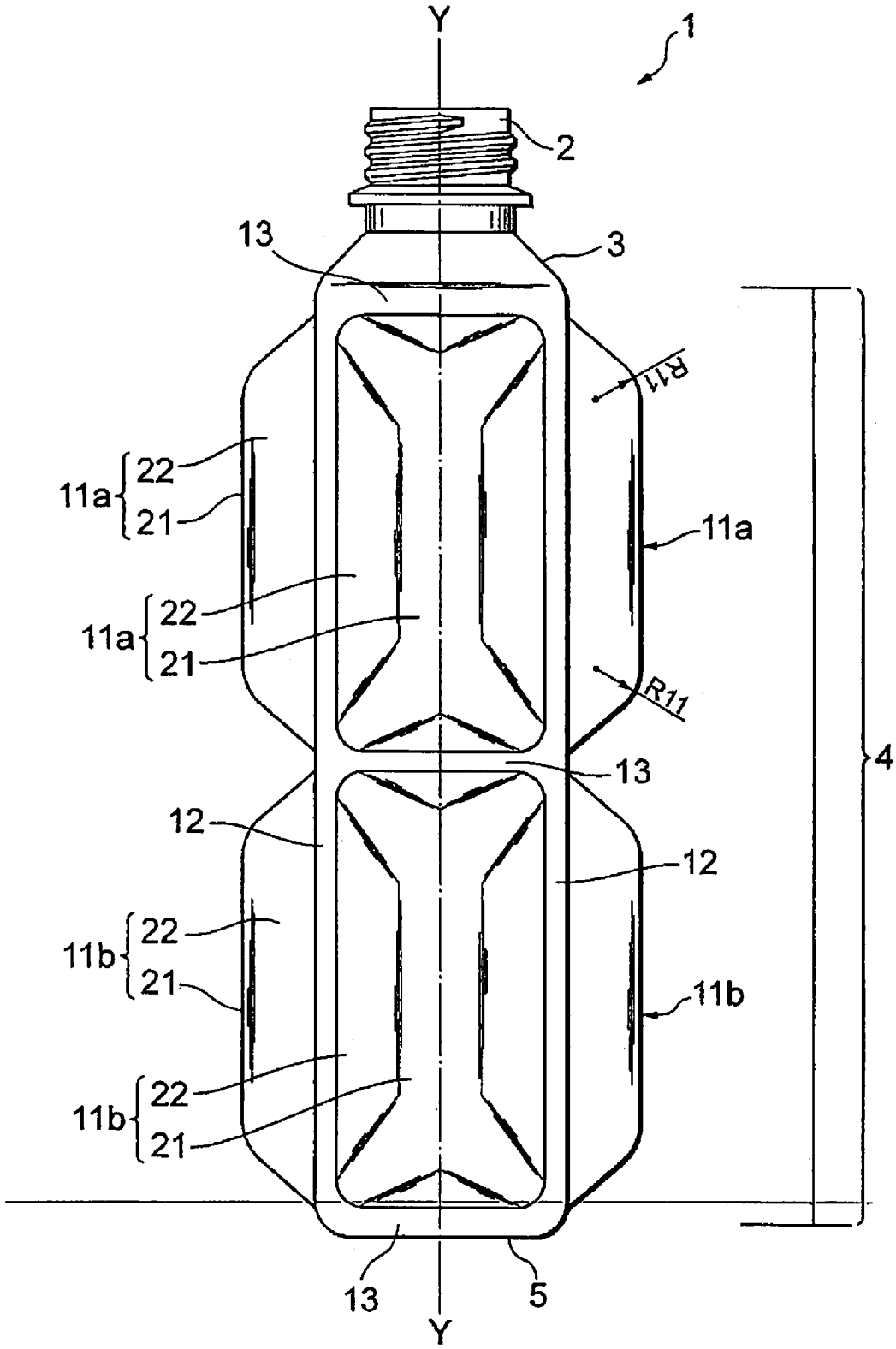
Figure 3:
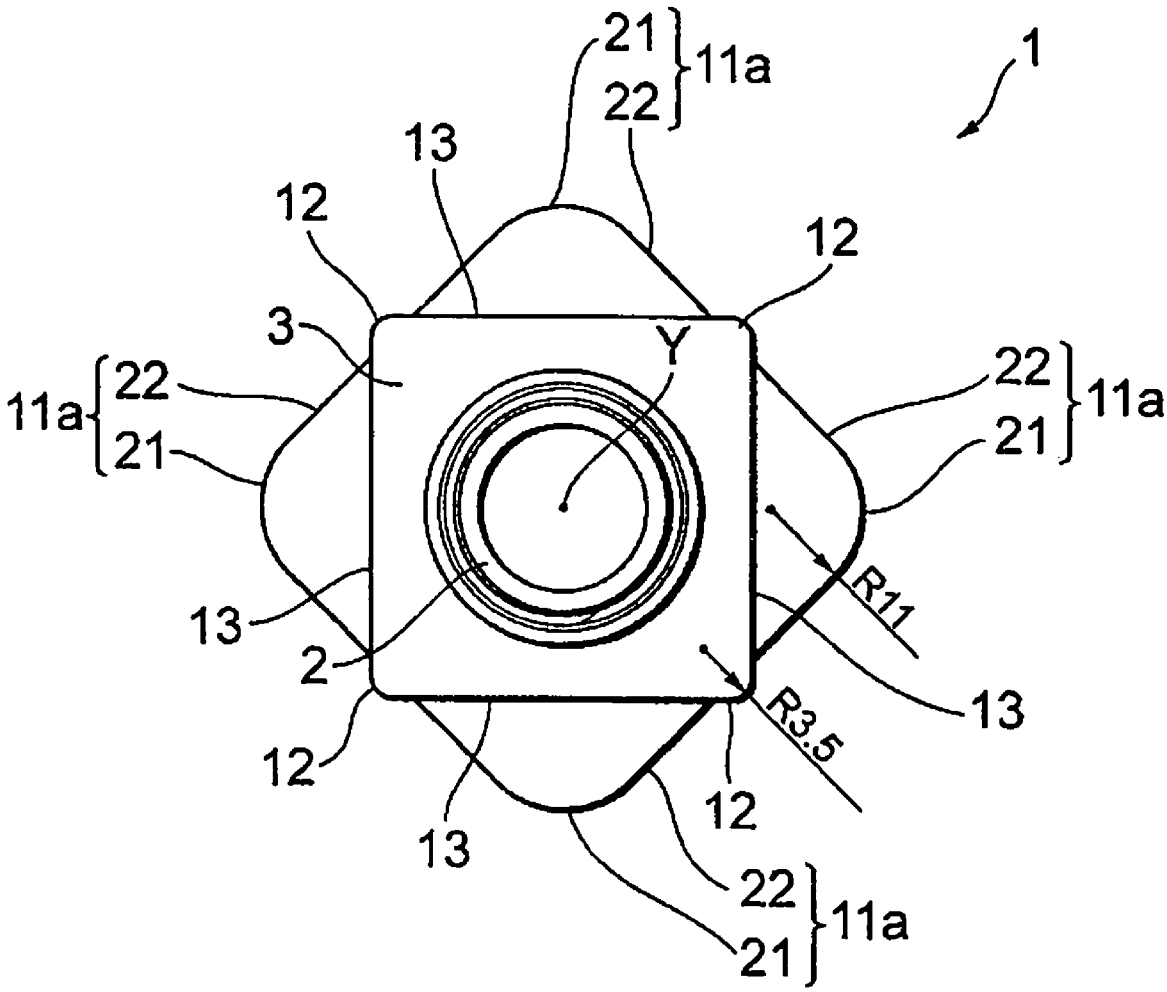

As shown in FIGS. 1-3, a plastic bottle 1 (hereinafter referred to simply as "bottle 1") may be manufactured by molding thermoplastic resin, such as polyethylene, polypropylene, or polyethylene terephthalate, by using various molding methods, such as blow molding, injection blow molding, or biaxial-stretch blow molding. After the formation, the bottle 1 may be washed and sterilized, for example, by heated water or chlorine sterilizer. Then the bottle 1 may be filled with its content, i.e. liquid.

Examples of the liquid poured into the bottle 1 include beverages, which may be various non-carbonated drinks including green tea, oolong tea, tea, coffee, and fruit juice. The liquid poured into the bottle 1 is not limited to beverages, but may also be food products such as sauce or sweet cooking rice wine, or may be carbonated drinks. However, the bottle 1 in the present embodiment is suitable for containing non-carbonated drinks, and can be easily collapsed so that the volume of space in the empty bottle 1 after drinking can be reduced.

The bottle 1 has a mouth portion 2, a shoulder portion 3, a body portion 4, and a bottom 5, in that order from the top of a central axis (vertical axis) Y-Y. The mouth portion 2, shoulder portion 3, body portion 4 and bottom 5 are continuously and integrally molded to form a bottle wall within which beverages can be stored inside the bottle 1.

The term "internally" used in the following description indicates the direction from the bottle wall toward a central axis Y-Y, or the direction inwards from the bottle wall. The term "externally" indicates the direction from the bottle wall away from the central axis Y-Y, or the direction outwards from the bottle wall.

Figure 4:
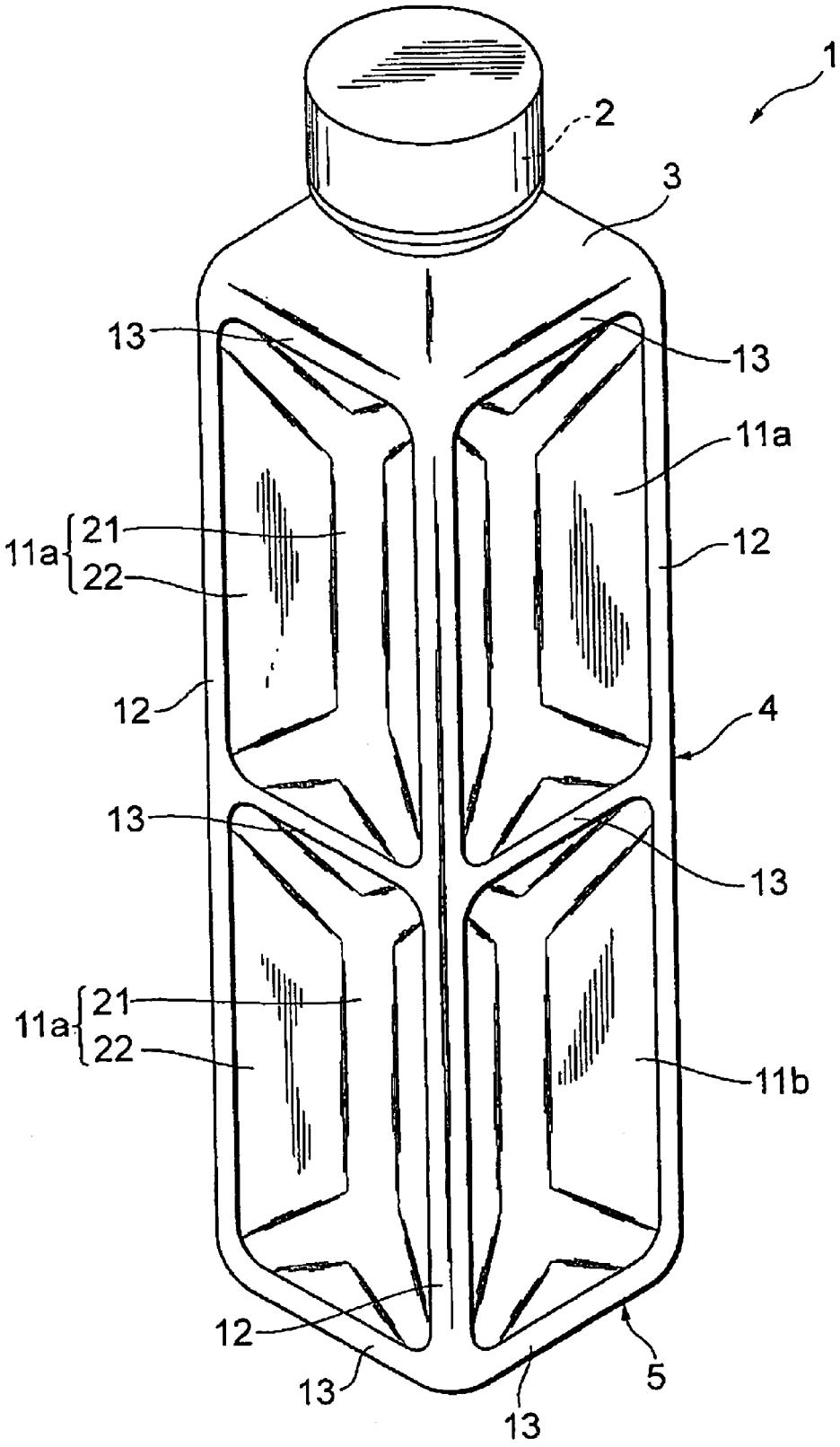
FIG. 4 is a perspective view of the plastic bottle in the embodiment, in which the volume is reduced.

The mouth portion 2 is positioned at the upper end of the bottle 1 and forms the minimum diameter of the bottle 1. The mouth portion 2 is open at its upper end and functions as a supply port or an outlet for beverages. The mouth portion 2 has a detachable cap. A consumer twists the cap between the opening position and closing position. Although the cap is shown in FIGS. 1, 4, and 5, no reference number is provided.

The shoulder portion 3 continues into the lower part of the mouth portion 2 and is inclined downwards. The shoulder portion 3 has a substantially square cross-sectional shape, but its shape is of course not limited to a square.

The bottom 5 is positioned at the lower part of the bottle 1. Although the bottom surface of the bottom 5 is square in the figure, its shape is of course not limited to a square.

The body portion 4 is an area between the shoulder portion 3 and the bottom 5. The body portion 4 is configured to be able to be collapsed in a direction perpendicular to the central axis Y-Y, or the horizontal direction. In the bottle 1, the shoulder portion 3, body portion 4, and bottom 5 are bordered by whether or not each portion includes the depressible panels 11*a* and 11*b* that can be depressed in the horizontal direction. More specifically, in the bottle 1, the cylindrical portion including the depressible panels 11*a* and 11*b* is referred to as the body portion 4. The portion that covers one end of the body portion 4 and does not include the depressible panels 11*a* and 11*b* is referred to as the bottom 5. The portion that continues into the other end of the body portion 4 and does not include the depressible panels 11*a* and 11*b* is referred to as the shoulder portion 3. The bottom 5 may include only the bottom surface, or also have a circumferential wall that extends from the circumferential edge of the bottom surface.

The circumferential wall of the body portion 4 includes the depressible panels 11*a* and 11*b*, first depression-resistant portions 12, and second depression-resistant portions 13. As will be described later, the depressible panels 11*a* and 11*b* (depressible portions) are depressed internally when external force is applied by a consumer's fingers, etc. The first and second depression-resistant portions 12 and 13 resist the external force applied by the consumer's fingers, etc., to the depressible panels 11*a* and 11*b*, and do not deform to be internally depressed.

The total number of depressible panels (11*a* and 11*b*) is eight, and they are formed to protrude externally. Among eight depressible panels 11*a* and 11*b*, four depressible panels 11*a* are formed in the upper part of the body portion 4 in the circumferential direction spaced apart at even intervals, and the other four depressible panels 11*b* are formed in the lower part of the body portion 4 in the circumferential direction spaced apart at even intervals. In this embodiment, the upper and lower parts of the body portion 4 are symmetrical, but they may also be asymmetrical. The number of the depressible panels may be freely decided.

The total number of the first depression-resistant portions 12 is four, and they extend in the central axis direction Y-Y. The first depression-resistant portions 12 are positioned at four corners of a square to function as columns to resist buckling. Each first depression-resistant portion 12 has rounded corners with, e.g. an R3.5 radius. The first depression-resistant portion 12 has almost the same length as the length of the body portion 4 in the central axis Y-Y direction. The first depression-resistant portion 12 and the depressible panel 11*a* are formed alternately in the circumferential direction and successive each other in the upper part of the body portion 4. The first depression-resistant portion 12 and the depressible panel 11*b* are formed alternately in the circumferential direction and successive each other in the lower part of the body portion 4.

The second depression-resistant portions 13 integrally join the upper edges, middle points, and lower edges of the two successive first depression-resistant portions 12 to function as beams. The total number of second depression-resistant portions 13 is twelve. The four second depression-resistant portions 13 formed in the upper part define the border between the shoulder portion 3 and the upper part of the body portion 4. The four second depression-resistant portions 13 formed in the middle part are positioned between the upper and lower depressible panels 11*a*, 11*b* and successive both of them. The four depression-resistant portions 13 formed in the lower part define the border between the bottom 5 and the lower part of the body portion 4. However, those lower depression-resistant portions 13 may be also regarded as a part of the bottom.

When the bottle 1 is seen from its front, the second depression-resistant portion 13, depressible panel 11*a*, second depression-resistant portion 13, depressible panel 11*b*, and second depression-resistant portion 13 are successive from the top in the direction of the central axis Y-Y. If seen in another way, each depressible panel 11*a* (or 11*b*) is formed in a substantially rectangular area surrounded by two successive first depression-resistant portions 12 and two successive depression-resistant portions 13.

As described above, the upper and lower depressible panels 11*a* and 11*b* have the same shape. Accordingly, both of them will be referred to as "depressible panel(s) 11" in the following description. However, if the upper and lower depressible panels have to be distinguished, the word "a" or "b" will be added to the reference number "11."

The depressible panel 11 includes a top section 21 and a protruding section 22. The top section 21 is a section that protrudes externally the most. The top section 21 may have a curved surface with, e.g. R11 radius having its center of curvature inside the bottle 1 (see FIG. 3) and extends by a prescribed length (for example 46 mm) in the central axis Y-Y direction. Because the top section 21 has the curved surface, compared with a top section having a flat surface, it can be pushed inwards with application of less power. Preferably, the width of the top section 21 may be about the width a consumer's finger (generally around 10 mm).

The protruding section 22 continues into the periphery of the top section 21. The protruding section 22 is formed to externally incline from two successive first depression-resistant portions 12, 12 and two successive depression-resistant portions 13, 13. The four corners of the protruding section 22, being in contact with the first depression-resistant portions 12 and the second depression-resistant portions 13, are rounded with, e.g., R 5 radius. Because, as described above, inclination is formed in the protruding section 22 and the corners of the base of the protruding section 22 are rounded, the protruding section 22 can easily be depressed internally when the top portion 21 is pushed internally.

The protruding section 22 also continues gently into the periphery of the top section 21. Particularly, in the protruding section 22, the part in contact with both ends in the longitudinal direction, which is the central axis Y-Y direction, of the top section 21 is a curved surface with, e.g., R11 radius, having its center of curvature inside the bottle 1 (see FIG. 2). With that configuration, the top section 21 and the protruding section 22 can easily be depressed internally when external force is applied to the top section 21. Particularly, the top section 21 and the protruding section 22 can easily be depressed by applying external force to the curved surface with R11 radius.

FIGS. 4 to 7 show the collapsed bottle 1.

First, how to collapse the bottle 1 will be described with reference to FIGS. 4 to 7. When collapsing the bottle 1, a consumer applies external force to push the top sections 21 in the depressible panels 11 from a direction crossing the central axis Y-Y direction (for example, a direction perpendicular to the central axis Y-Y direction), and has the top section 21 gradually depressed internally. The depressible portion 11 is depressed internally by pushing the top section 21 to the end and internally collapsing the protruding section 22. The bottle 1 is completely collapsed by having all depressible panels 11 depressed. The first and second depression-resistant portions 12 and 13 resist the internal depression when external force is applied by the consumer.

Figure 5A:
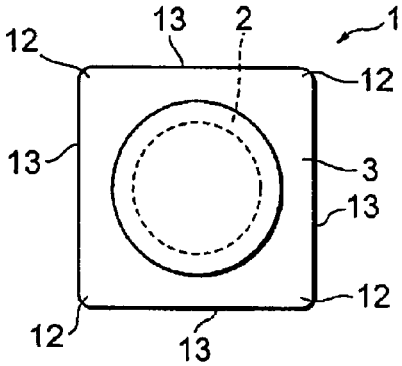
FIGS. 5A, 5B, and 5C respectively are a top view, front view, and bottom view of the plastic bottle in the embodiment, in which the volume is reduced.
Figure 5C:
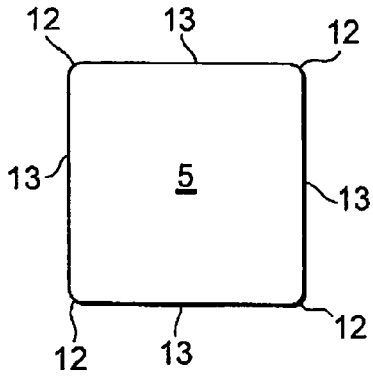
Figure 5B:
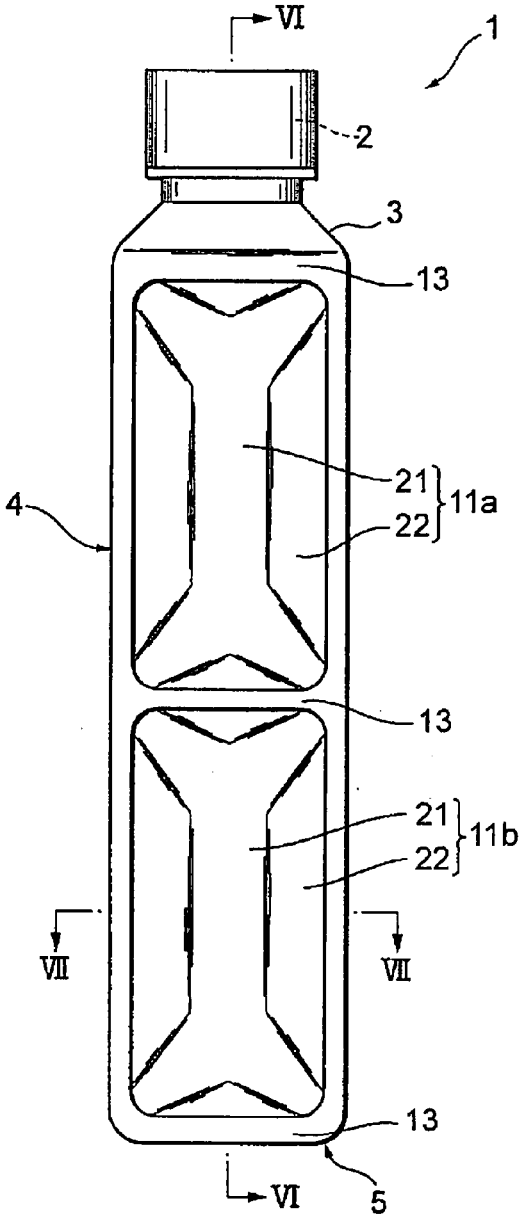
Figure 6:
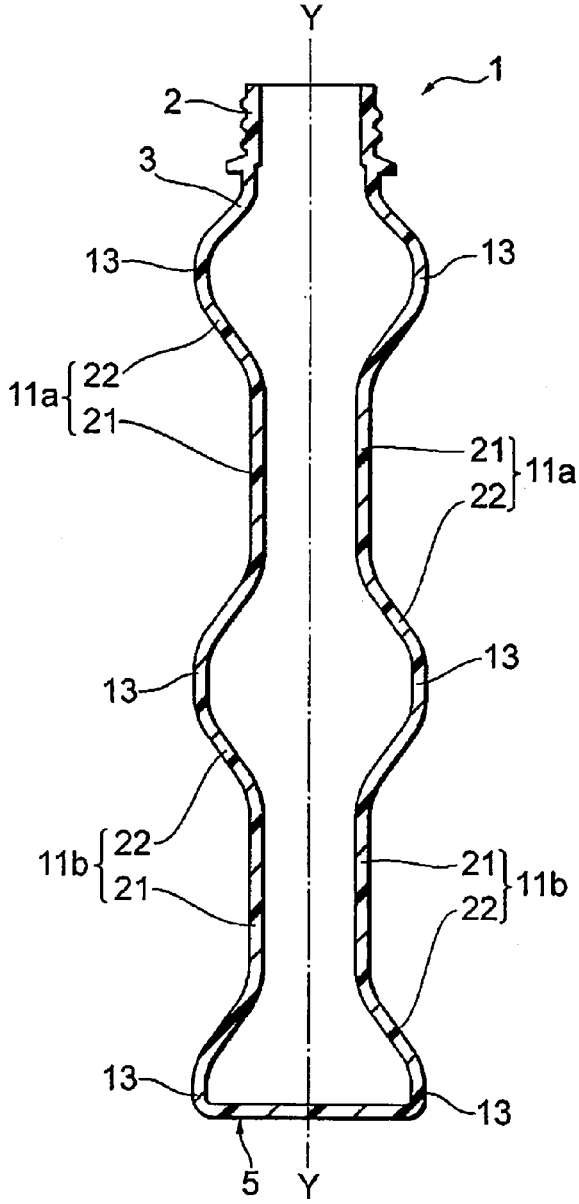
FIG. 6 is a cross sectional view along the line VI-VI in FIG. 5B.

Next, the bottle 1 in a collapsed state will be described. When the bottle 1 is collapsed, the pre-collapse depressible panels 11 fold in on themselves and are completely reversed. In the collapsed bottle 1, the depressible panels 11 are closer to the central axis Y-Y than the first and second depression-resistant portions 12 and 13. Particularly, as shown in FIGS. 5A, 5B and 5C, no portions protrude more externally than the first and second depression-resistant portions 12 and 13 in the collapsed bottle 1, and the bottle 1 seems like a rectangular bottle. The reason is that the strength of the bottle 1 is kept by the first and second depression-resistant portions 12 and 13 so that it can stand by itself.

Figure 7:
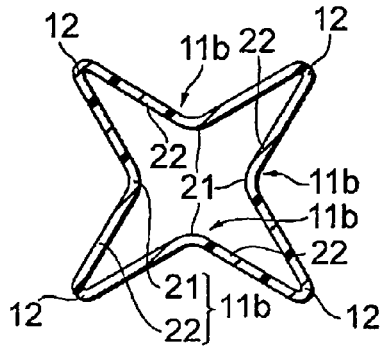
FIG. 7 is a cross sectional view along the line VII-VII in FIG. 5B

As shown in FIG. 7, in the collapsed bottle 1, the cross section of the lower part of the body portion 4 has a substantially X-character shape. Inside the body portion 4, the top sections 21 in the plural depressible panels 11*b* are spaced apart from each other so as not to interfere with each other, and the protruding sections 22 in the plural depressible panels 11*b* are spaced apart from each other so as not to interfere with each other. Similarly, the depressible panels 11*a* do not interfere with each other inside the body portion 4, and the cross section of the upper part of the body portion 4 has a substantially X-character shape, which is not shown in the figures.

As described above, the bottle 1 in this embodiment is useful in terms of its strength when used, easy collapsibility after use, recycling efficiency, portability, and beverage quality maintenance, etc.

More specifically, the bottle 1 can keep its strength and shape with the depression-resistant portions 12 and 13 during use. Particularly, the second depression-resistant portions 13 between the depressible panels 11*a* and 11*b* effectively function as ribs that can enhance the strength (i.e. horizontal stiffness) against external force from the horizontal direction. Moreover, as the middle parts in the body portions 4 may be narrower by providing the second depression-resistant portions 13, the consumer can hold the bottle 1 and open/close the cap more easily.

Meanwhile, the depressible panel 11 can be designed more freely in terms of its strength, because the strength can be maintained with the depression-resistant portions 12 and 13. For example, a vacuum area, e.g. a concave panel may be formed in a part of the depressible panels 11. With such a configuration, pressure reduction that occurs in the bottle 1 after beverage is filled can be absorbed at that part of the depressible panel 11, and the commercial value of the bottle 1 can be maintained.

Since the depressible panel 11 is formed to protrude, the volume of space in the bottle 1 can be satisfactorily kept. Meanwhile, from the consumer's viewpoint, the consumer is made aware of the protrusion in the depressible panel 11. Accordingly, the consumer can also recognize that the body portion 4 can be collapsed by depressing the depressible panel 11.

The depressible panel 11 can be depressed internally after using the bottle 1 by applying external force to the depressible panel 11 from the horizontal direction. Particularly, the depressible panel 11 can easily be depressed and the volume of space in the bottle 1 can be reduced by configuring the depressible panel 11 in the above described way. Since the body portion 4 can easily be collapsed, the burden on consumers can be reduced, which may promote recycling.

Moreover, the bottle 1 can be collapsed into the shape, which is the shape with the depressed depressible panels 11, intended by the manufacturer. Also, the bottle 1 can be collapsed while maintaining its original strength with the depression-resistant portions 12 and 13. Seen from another viewpoint, a consumer can depress the depressible panels 11 gradually or as necessary, e.g. based on drink consumption during use.

For example, a consumer can reduce the volume of the empty space in the bottle 1 every time after the consumer drinks a small amount of the beverage. In other words, the bottle size can be reduced by collapsing the depressible panels 11 one by one according to the consumer's progress through the drink. With such a configuration, the storability and portability in a bag can be improved. Since the volume in the bottle 1 can be gradually reduced during drinking, the amount of air the beverage in the bottle 1 may be in contact with can also be reduced. Accordingly, the effect of air on the beverage, specifically the effect of oxygen can be reduced, so the quality of the beverage can be kept high.

Since the volume of space in thus collapsed bottle 1 is reduced, the collapsed bottle 1 does not occupy much space in a recycling box or a consumer's bag. Also, the collapsed bottle 1 seems to be a substantially square bottle. Accordingly, a machine system in a recycling system for bottles can be simplified if those square bottles are collected and supplied to the recycling system. Since the depressible panels 11 do not interfere with each other inside the collapsed bottle 1, the recycling system can perform transparency checks for recognizing material used for the collapsed bottle 1.

The bottle 1 in the present invention 1 can be modified in various ways. For example, one or more convex groove(s) may be formed in the top section 21 in each depressible panel 11. Thus, the top section 21 can be depressed more easily. Particularly, if plural convex grooves are arranged in the central axis Y-Y direction, the top section 21 can be gradually depressed. Also, the shape of the depressible panels 11 is not limited to the above described embodiment, and may be a dome-like shape, web-like shape, or step-like shape.

INDUSTRIAL APPLICABILITY

The configuration of the body portion 4 that can be collapsed by applying pressure to the plastic bottle 1 in the present invention can also be applied to bottles made of metal, such as aluminum. Also, the liquid poured into the plastic bottle 1 may be not only beverages, but also medical agents or detergents, etc.

The invention claimed is:

1. A plastic bottle having a body portion that collapses internally when an external force is applied, comprising:

at least one depressible portion formed on a circumferential wall of the body portion to protrude externally, the at least one depressible portion being depressed internally when the external force is applied, depression-resistant portions formed on the circumferential wall of the body portion, the depression-resistant portions being adjacent to the at least one depressible portion, the depression-resistant portions being configured to resist depression from the external force, the depression-resistant portions including a plurality of first depression-resistant portions extending in a direction of a central axis of the plastic bottle and a plurality of second depression-resistant portions extending in a circumferential direction of the body portion, wherein at least one of the plurality of second depression-resistant portions integrally joins an upper edge of at least one of the plurality of first depression-resistant portions, wherein at least one of the plurality of second depression-resistant portions integrally joins a middle point of at least one of the plurality of first depression-resistant portions, wherein at least one of the plurality of second depression-resistant portions integrally joins a lower edge of at least one of the plurality of first depression-resistant portions, and wherein when the at least one depressible portion is depressed internally, the plurality of first and second depression-resistant portions form a maximum perimeter of the plastic bottle.

2. The plastic bottle according to claim 1, wherein a plurality of depressible portions and the plurality of first depression-resistant portions are formed alternately in a circumferential direction of the body portion.

3. The plastic bottle according to claim 2, wherein the plurality of depressible portions and the plurality of second depression-resistant portions are formed alternately in the direction of the central axis of the plastic bottle.

4. The plastic bottle according to claim 2 or 3, wherein when the plurality of depressible portions are depressed internally, the plurality of depressible portions end up closer to the central axis of the plastic bottle than the depression-resistant portions.

5. The plastic bottle according to claim 2, wherein the plurality of depressible portions are configured not to interfere with each other in the body portion when the plurality of depressible portions are depressed internally.

6. The plastic bottle according to claim 1, wherein the at least one depressible portion includes:

an externally protruding section, and a top section, wherein the externally protruding section is inclined and continues to a periphery of the top section.

7. The plastic bottle according to claim 1, wherein the at least one depressible portion comprises:

a top section that protrudes externally the most, and a protruding section that continues into the periphery of the top section, wherein the top section is curved to have its center of curvature inside the plastic bottle.

8. The plastic bottle according to claim 7, wherein the top section extends in the direction of the central axis of the plastic bottle.

9. A plastic bottle having a body portion that collapses internally when an external force is applied, comprising:

a plurality of depressible portions formed on a circumferential wall of the body portion, the plurality of depressible portions being depressed internally when the external force is applied a plurality of first depression-resistant portions formed on the circumferential wall of the body portion, the plurality of first depression-resistant portions being adjacent to the plurality of depressible portions, the plurality of first depression-resistant portions being configured to resist depression from the external force, the plurality of first depression-resistant portions extending in a circumferential direction of the body portion, a plurality of second depression-resistant portions formed on the circumferential wall of the body portion, the plurality of second depression-resistant portions being adiacent to the plurality of depressible portions, the plurality of second depression-resistant portions being configured to resist depression from the external force, the plurality of second depression-resistant portions extending in a direction of a central axis of the plastic bottle, wherein the plurality of first depression-resistant portions and the plurality of second depression-resistant portions define a perimeter of each of the plurality of depressible portions, wherein at least one of the first depression-resistant portions divide the plastic bottle into an upper portion and a lower portion, wherein when the plurality of depressible portions are depressed internally, the plurality of first depression-resistant portions and the plurality of second depression-resistant portions form a maximum perimeter of the plastic bottle.

10. The plastic bottle according to claim 9, wherein the plurality of depressible portions and the plurality of second depression-resistant portions are formed alternately in the circumferential direction of the body portion.

11. The plastic bottle according to claim 10, wherein the plurality of depressible portions and the plurality of first depression-resistant portions are formed alternately in the direction of the central axis of the plastic bottle.

12. The plastic bottle according to claim 10 or 11, wherein when the plurality of depressible portions are depressed internally, the plurality of depressible portions end up closer to the central axis of the plastic bottle than the plurality of first depression-resistant portions and the plurality of second depression-resistant portions.

13. The plastic bottle according to claim 10, wherein the plurality of depressible portions are configured not to interfere with each other in the body portion when the plurality of depressible portions are depressed internally.

14. The plastic bottle according to claim 9, wherein each of the plurality of depressible portions include:

an externally protruding section, and a top section, wherein the externally protruding section is inclined and continues to a periphery of the top section.

15. The plastic bottle according to claim 9, wherein each of the plurality of depressible portions comprise:

a top section that protrudes externally the most, and a protruding section that continues into the periphery of the top section, wherein the top section is curved to have its center of curvature inside the plastic bottle.

16. The plastic bottle according to claim 15, wherein the top section extends in the direction of the central axis of the plastic bottle.

* * * * *